United States Patent [19]

Morooka et al.

[11] 4,162,624

[45] Jul. 31, 1979

[54] TENSION CONTROL METHOD FOR A ROLLING MILL

[75] Inventors: Yasuo Morooka; Shinya Tanifuji, both of Hitachi, Japan

[73] Assignee: Hitachi, Ltd., Japan

[21] Appl. No.: 892,180

[22] Filed: Mar. 31, 1978

[30] Foreign Application Priority Data

Mar. 31, 1977 [JP] Japan ..... 52/35269

[51] Int. Cl.[2] ..... B21B 37/00

[52] U.S. Cl. ..... 72/8; 72/17

[58] Field of Search ..... 72/205, 6–8, 72/10, 19, 21, 17

[56] References Cited

U.S. PATENT DOCUMENTS

| | | | |
|---|---|---|---|
| 3,387,472 | 6/1968 | Pallen | 72/17 |
| 4,033,492 | 7/1977 | Imai | 72/17 X |

*Primary Examiner*—Milton S. Mehr

*Attorney, Agent, or Firm*—Craig and Antonelli

[57] ABSTRACT

In the control of the tension of a workpiece which is rolled by a tandem rolling mill, a tension control method for a rolling mill wherein the tension of a workpiece is controlled by a looperless tension control method employing no looper at the threading stage of the top end and at the tail-out stage, and it is controlled by a tension control method employing a looper during the steady rolling.

12 Claims, 7 Drawing Figures

TENSION CONTROL METHOD FOR A ROLLING MILL

BACKGROUND OF THE INVENTION

1. Field of the Invention

This invention relates to a method of controlling a tension which acts on a workpiece fed in between the stands of a tandem rolling mill. More particularly, it relates to a method of selective control between a tension control method with a looper and a looperless tension control method.

During the threading stage of the top end and during the tailout stage, it is difficult to precisely control the tension by means of the looper, and hence, the looperless tension control is made. Under the steady rolling state, the tension control employing the looper is made.

2. Description of the Prior Art

In a broad sense, this invention concerns the control of a tension between respective stands in a tandem rolling mill.

In the tandem rolling mill in which the adjacent stands are coupled by the tension of a strip, when the final thickness of the strip produced is to be held constant, each interstand tension should be controlled into a substantially constant value during the operation of the rolling mill so that the material of an identical volume may pass every predetermined unit time.

For this tension control, the two control methods of the so-called looperless control method and the control method with a looper have been tried.

First, the looperless tension control method will be explained. U.S. Pat. No. 3,940,960 entitled "Interstand Tension Control Method and Apparatus for Tandem Rolling Mills" (Mar. 2, 1976, by S. Tanifuji et al) has been issued to the same applicants as in the present application, and its contents are as stated below.

In a method of controlling a tension which acts on a workpiece threaded between rolling stands of a tandem rolling mill constructed of at least a first stand and a second stand, the patented invention is fundamentally characterized by comprising the step of calculating a reference torque arm of said first stand in a period from the threading of said workpiece into said first stand to the threading thereof into said second stand, the step of detecting torque arms of said first and second stands at a time immediately after the threading of said workpiece into said second stand, and calculating a reference torque arm of said second stand from the detected torque arms of said first and second stands and said reference torque arm of said first stand and then storing the calculated result, and the step of thereafter detecting torque arms of said first and second stands during rolling (under the state under which said workpiece is threaded into both said first and second stands), calculating a difference between a variation of the detected first-stand torque arm value from the first-stand reference torque arm and a variation of the detected second-stand torque arm value relative to the second-stand reference torque arm, and controlling the tension of said workpiece between said first and second stands into a constant value according to the calculated difference value.

This expedient determines the reference torque arm of each stand with the torque arms of the ajacent stands immediately after the threading of each stand and the torque arm of the preceding stand at no tension, not with the torque arm immediately after the threading of each stand, and therefore has such an effect that the error of a detected value ascribable to an impact drop immediately after the threading is little.

On the other hand, the tension control method with a looper is disclosed in, for example, U.S. Pat. No. 3,332,263 entitled "Computer Control System for Metals Rolling Mill" (July 25, 1967, by R. G. Beadle et al).

This concerns the automatic operation of a hot steel-plate rolling mill by the instructions of a controlling computer. The computer stores an operating program, and besides, it receives input data and external control data and combines them with the stored program so as to sequentially renew the program.

FIGS. 2A-2D of the drawings of the cited patent show schematic views of a rolling mill, and Column 5, line 55—Column 6, line 24 of the specification thereof refer especially to the control of the looper.

As set forth above, there are the two methods of controlling the tension without and with the looper. In the technical field of the rolling mill control employing a digital computer, the looperless control method is being adopted increasingly. However, any literature or report stating merits owing to the joint use with the looper control is not found.

BRIEF SUMMARY OF THE INVENTION

The principal object of this invention is to provide a tension control method for a tandem rolling mill s based on the combined use of the looperless tension control method and the looper tension control method.

Another object of this invention is to provide a tension control method for a tandem rolling mill wherein a tension is controlled by changing-over the looperless tension control method and the looper tension control method in dependence on the running state of the tandem rolling mill.

Another object of this invention is to provide a tension control method for a tandem rolling mill as can carry out the tension control throughout the process of rolling from the threading stage of the top end to the tail-out stage.

A further object of this invention is to provide a tension control method for a tandem rolling mill as is suitable for the rolling of hot band steel, die steel, wire steel, bar steel etc. for which the control precision of the tension is severe.

This invention for accomplishing the objects is characterized by monitoring a rolling speed and changing-over the looperless tension control method to the looper tension control method upon arrival at a steady running speed.

Another characterizing feature of this invention consists in that the control is changed-over to the looperless tension control method upon command of a "tail-out" operation mode.

Another characterizing feature of this invention consists in that the change-over from the looperless tension control method to the looper tension control method goes through a region in which both the control methods coexist.

Another characterizing feature of this invention consists in that the change-over from the looper tension control method to the looperless tension control method goes through a region in which both the control methods coexist.

DESCRIPTION OF THE PREFERRED EMBODIMENTS

First of all, matters underlying this invention will be described.

In a hot strip mill, desirably a tension acting on a workpiece is controlled within approximately 0.5 $kg/mm^2$ in usual cases. An excessively high or low tension on the workpiece is unfavorable because it incurs the degradation of the quality of a product, the lowering of the production efficiency, the deterioration of the "top-end threading" property, etc.

For this reason, there has heretofore been used a looper which stabilizes the tension by electrically or mechanically establishing a balance. The looper is a device which exhibits an excellent control characteristic under a steady rolling state.

The looper, however, involves the problem that the tension changes due to the operation thereof when it is raised or lowered at the threading stage of the top end, at the tail-out stage, or at the acceleration or deceleration of the rolling. Especially during the threading stage of the top end, it is difficult to set a looper positioning command by pre-estimating a loop quantity. Even if the pre-estimate is possible, its precision is inferior. It turns out that the looper adversely applies an excessive tension when it touches the strip. This must be avoided in the tension control.

In consideration of a load allotment in the data processing of a computer which controls the rolling mill, the computer is used only in regions such as the threading stage of the top end and the tail-out stage in which the tension control with the looper is difficult, and the control with the looper is made in any other region, whereby the load of the computer is relieved. To perform the tension control with the computer in all the regions increases the processing load by 20%–50% and is therefore a serious problem though this cannot be absolutely said because the processing speed and the memory capacity of the computer are also relevant.

As regards the process of the control to a set tension, the looper control has such problems that the overshoot is great and that it takes a long time to reach the steady state after the occurrence of a hunting.

In view of the disadvantages of the prior-art system, according to this invention, the tension controls at the threading stage of the top end and at the acceleration or deceleration of the rolling are not effected by the tension control with the looper, but are effected by the looperless tension control method.

Prior to the detailed explanation of this invention, the control method with the looper will be described.

Figure 1:
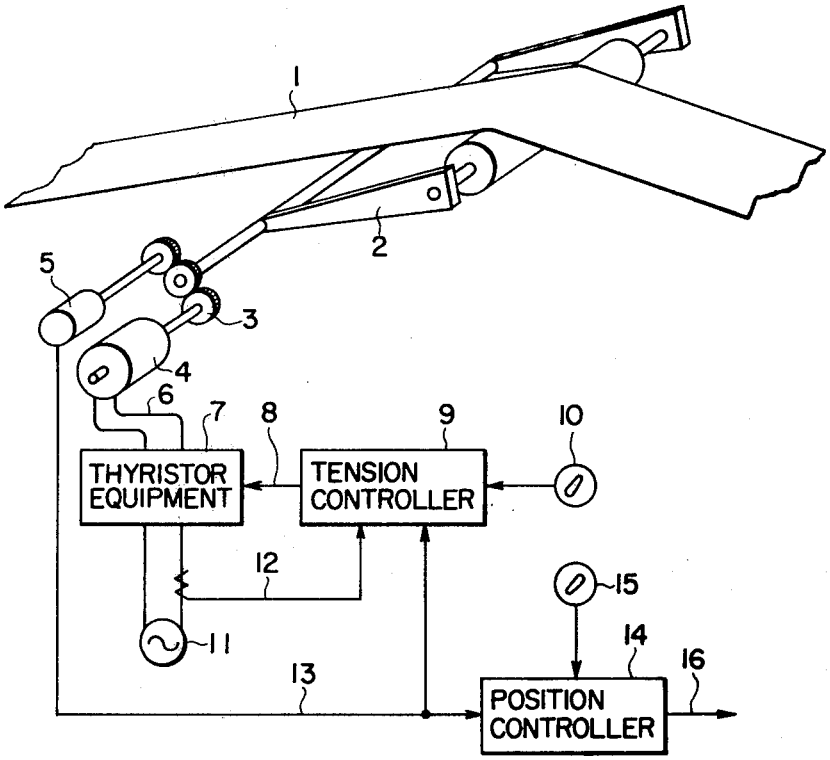
FIG. 1 shows a schematic view for explaining the method of tension control with a looper.

FIG. 1 is a view for elucidating the tension control method based on the looper.

A workpiece 1 is endowed with a tension in such a way that a looper 2 pushes the workpiece 1 upwards. The looper 2 is driven through reduction gears 3. Numeral 4 designates a driving motor, numeral 5 a looper position detector adapted to detect the position of the looper from the rotational angle thereof, and numeral 6 feeder lines for the driving motor 4. Shown at 7 is a gate control device such as thyristor equipment, which converts an input voltage from a power source 11 into a voltage to be impressed on the motor 4 in accordance with a current command signal 8 and causes a predetermined current to flow through the motor 4. Shown at 9 is a tension controller. It receives a set tensile value from a tension setter 10 and a signal 13 of the looper position detector 5, to prepare a current control command value dependent upon the positional signal, and it delivers the current command signal 8 dependent upon a deviation from an actual-current detection signal 12, to control the motor 4. Shown at 14 is a position controller. It receives a looper position command value from a position setter 15, and delivers a speed correcting signal 16 for a main motor, not shown, in dependence on a signal of deviation from the looper position signal 13.

Figure 2:
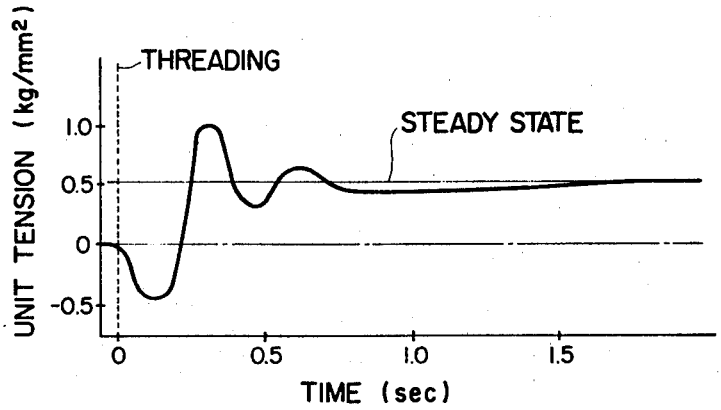
FIG. 2 shows an example of a characteristic by the simulation of a tension variation at the time when the looper has been raised from its stand-by state.

The looper apparatus is arranged between the stands of a tandem rolling mill. The looper disposed between the stands on the upper stream and lower stream sides controls the interstand tension in such a way that when the workpiece has reached the stand on the lower stream side, the looper is started and has its position controlled. In general, during the threading stage, the looper is held lowered to stand by in order to prevent the top end or foremost end of the workpiece from touching the looper and giving rise to troubles. When the looper is started upon arrival of the workpiece at the stand on the lower stream side, the looper rises from the stand-by position and raises the workpiece about 100 mm. In many cases, the tension becomes excessive at this time. FIG. 2 illustrates the situation by a simulation. In this graph, the axis of ordinates represents the tension (in $kg/mm^2$) acting on the workpiece, while the axis of abscissas represents the time. When the workpiece has reached the stand on the lower stream side at time 0 (zero), the speed of the main motor of the lower stream side-stand lowers due to a rolling load. Therefore, the workpiece is somewhat sagged and is subject to a compression. The looper starts at that time, and rises until a predetermined tensile value and a predetermined position are reached. Although the compression having developed due to the sag of the workpiece is eliminated by the rise of the looper, the workpiece is knocked by the rise of the looper to the predetermined position and undergoes a tension abruptly. As shown in FIG. 2, the tension becomes greater than the predetermined tension transiently. Disadvantageously, the generation of such an excessive tension leads to damaging the workpiece or changing the thickness, width, shape etc. of the workpiece. In the prior-art system, therefore, a measure called the "soft touch control" in which the rising speed of the looper is controlled with the rise thereof is adopted. Such a measure, however, has not become a drastic solution yet. It has been recognized from simulations and the experiences of actual operations that the tensile fluctuations are similarly great in case of increasing or decreasing the rolling speed. Accordingly, a comparatively stable tension control can be made under the running state including neither the acceleration nor the deceleration of the rolling, that is, under the steady rolling state.

On the other hand, it has also been attempted to control the tension of the workpiece by the looperless tension control method. The technique is described in, e.g., U.S. Pat. No. 3,940,960 as already referred to, and its details are left to the explanation in the specification of the patent. It is suitable especially for the tension controls at the acceleration and deceleration.

In view of the above-stated disadvantages of the prior-art system, this invention has been realized by developing a technique to be stated below. It eliminates the disadvantages while keeping the merits of the looper, and does not reside in merely assembling any other tension controller into a rolling system instead of the looper. In case where the tension controls during the threading stage of the foremost end and during the acceleration or deceleration are executed by a non-contacting tension controller which controls the interstand tension is a non-contacting fashion, in place of the looper, there are many nonlinear operations such as multiplications and divisions, and hence, a control with a digital computer is suitable. The reasons why the non-contacting tension controller is not used throughout the rolling process, are as follows.

First, during the steady rolling, since the rolling state is stable, it is unnecessary to conduct a complicated control, and the control accuracy can be made satisfactorily high by the tension control method employing the looper.

The second reason is that, during the steady rolling, the execution of a set-up control and an adaptation control for the ensuing workpiece is important, the use of the computer being more effective for such control purposes.

Now, this invention will be described in detail in connection with an embodiment.

Figure 3:
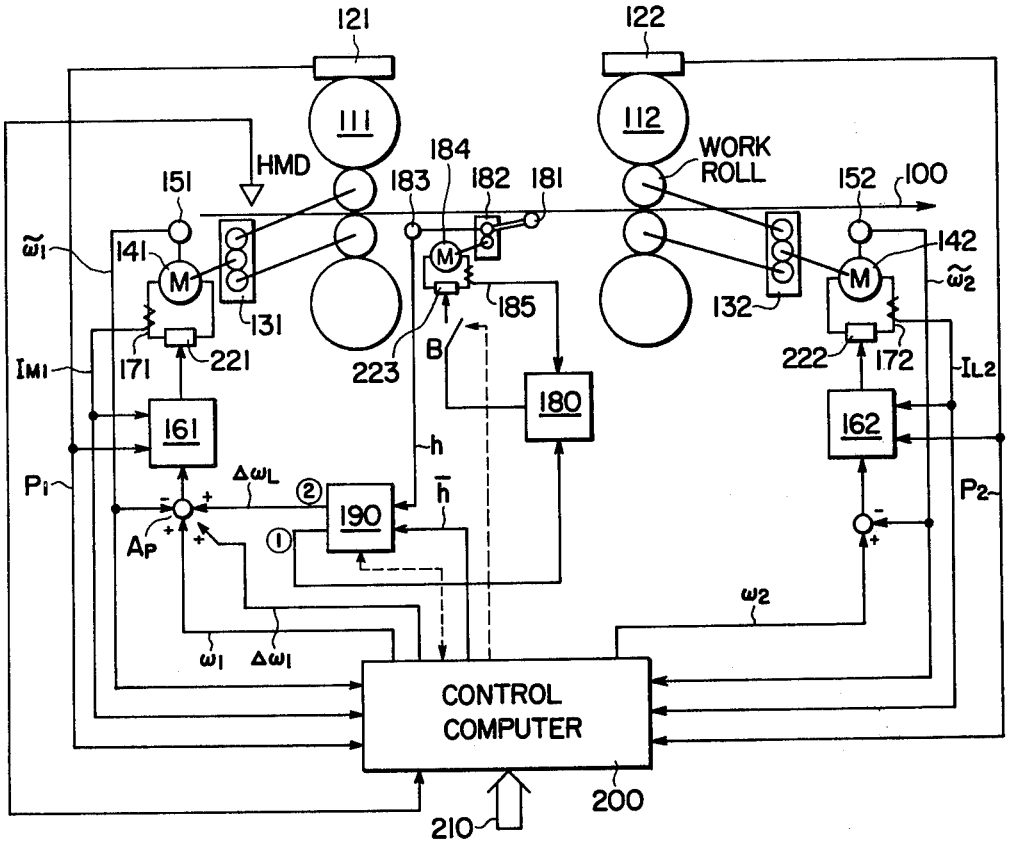
FIG. 3 shows a constructional view in the case of two stands for explaining a concrete embodiment of this invention.
Figure 4:
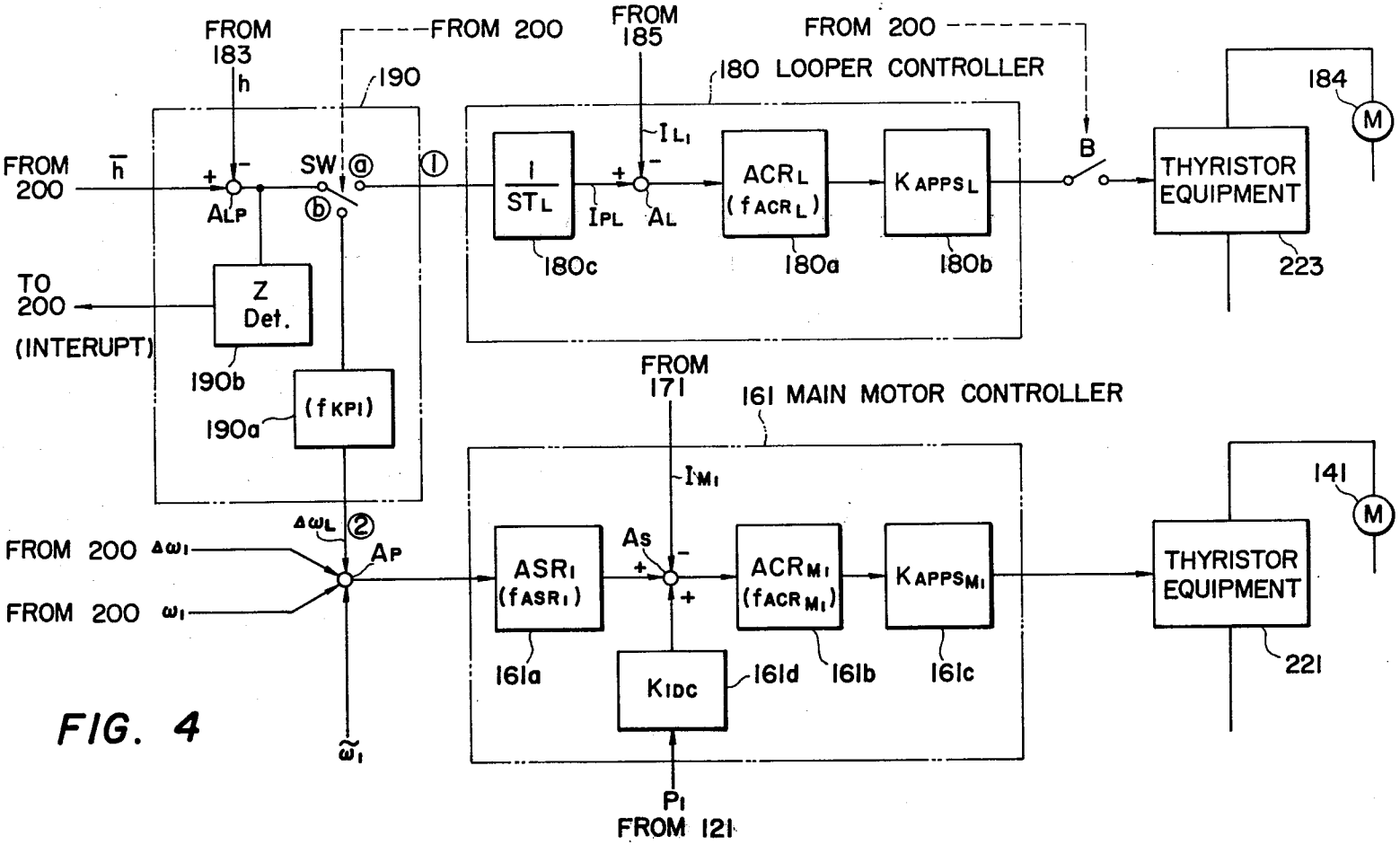
FIG. 4 shows a detailed block diagram in the construction of FIG. 3.

FIG. 3 shows an embodiment of this invention. Numeral 100 designates a workpiece. Numerals 111 and 112 indicate rolling mill stands. Herein, only the two stands are illustrated for the brevity of explanation. Numerals 121 and 122 indicate rolling pressure detectors, which are made up of known load cells. Shown at 131 and 132 are gears, through which main motors 141 and 142 rotate work rolls of the rolling stands 111 and 112 respectively. Speed detectors 151 and 152 detect the rotational speeds of the main motors 141 and 142, respectively. Speed controllers 161 and 162 control the rotational speeds of the main motors 141 and 142, respectively. As shown in FIG. 4 as to the case of the speed controller 161, this speed controller consists of a speed control portion (ASR) 161*a*, a current control portion (ACR) 161*b*, a pulse converter ($K_{APPSM}$) 161*c* and a load current control portion ($K_{IDC}$) 161*d*, and it delivers a gate signal of a thyristor to a thyristor equipment 221. The component 161*d* controls the current of the main motor 141 in proportion to the rolling pressure, and compensates for a speed lowering at the time of an impact.

The main motor controller 161 will be described more in detail. The transfer function $f_{ASR}$ of the speed control portion 161*a* being $ASR_1$ is given by Eq. (1):

$$f_{ASR1} = K_M\left(1 + \frac{1}{T_M s}\right) \tag{1}$$

$K_{M1}$: Constant of the speed control system of the main motor of the first stand, $T_{M1}$: Time constant of the speed control system of the main motor of the first stand.

At an addition point $A_s$, a signal $I_{M1}$ from the main motor current detector 171 of the first stand, a load signal $P_1$ from the load cell 121 as has gone through the impact drop-compensating portion 161*d* ($K_{IDC}$), and an output signal of the component $ASR_1$ are added. The sum is entered into the current control portion 161*b* being $ACR_{M1}$. The transfer function $f_{ACRM1}$ of the component $ACR_{M1}$ is given by Eq. (2):

$$f_{ACRM1} = \frac{1 + T_A \cdot s}{s\,T_c} \tag{2}$$

$T_C$, $T_A$: Time constants of the current control system.

The pulse converter 161*c* is a device for obtaining the gate-controlling pulse signal of the thyristor equipment 221, and it is represented as $K_{APPSM1}$. This output signal controls the thyristor equipment, and consequently controls the speed of the main motor 141 of the first stand.

Numerals 171 and 172 designate current detectors, which detect the driving currents of the main motors 141 and 142 respectively.

Since the foregoing construction of the speed controller 161 applies similarly to the speed controller 162 for controlling the main motor of the second stand, no repetitious explanation will be made here. Since this embodiment is described with notice taken of the two stands of the tandem rolling mill, the omission of the explanation on the second stand will not impede understanding of this invention.

Description will now be made of a looper controller 180 which controls the driving current of a looper motor 184. As shown in FIG. 4, it is constructed of a current control portion 180*a* being $ACR_L$, a pulse conversion portion 180*b* being $K_{APPSL}$, and an integration element portion 180*c*.

The integration element 180*c* receives a signal of an output terminal ① of a looper position regulator 190, integrates it with an integration time constant $T_L$ (the transfer function is $$\frac{1}{sT_L}),$$

and delivers a current signal $I_{PL}$. At an addition point $A_L$, the current signal $I_{PL}$ and a feedback current signal $I_L$ from a current detector 185 which detects the driving current of the looper motor 184 are added. The sum is made an input signal of the current control portion 180*a* being $ACR_L$. The transfer function $f_{ACRL}$ of the component $ACR_L$ is given by Eq. (3):

$$f_{ACRL} = \frac{1 + T_{AL} \cdot s}{s\,T_{CL}} \tag{3}$$

$T_{AL}$, $T_{CL}$: Time constants of the ACR system.

An output signal of the component $ACR_L$ is entered into the pulse conversion portion 180*b*, an output signal of which becomes a gate control signal of a thyristor equipment 223.

Numeral 181 designates a looper, numeral 182 gears, and numeral 183 a looper position detector which is made up of, for example, a selsyn signal generator. As stated above, the current detector 185 detects the driving current of the looper motor 184. The looper position regulator 190 detects the looper position by means of the position detector 183, and as shown in FIG. 4, it delivers a correcting signal for the rotational speed of the main motor 141 according to a positional deviation. Shown at 200 is a computer. It receives rolling specifications 210, and carries out, besides set-up computations as well as information processings, the non-contacting tension control being the principal function of this invention, the starting and separation of the looper control system, the settings of desired values of currents, a looper position etc., the setting of a gain, and so forth.

Here, the looper position regulator 190 will be described more in detail.

It is constructed of a comparison portion $A_{LP}$ for comparing a looper position setpoint h from the computer 200 and a position signal $\bar{h}$ from the looper position detector 183, a change-over switch sw for changing-over the transmission of a signal of the comparison portion between side ⓐ and side ⓑ, a P-I element (proportion-integration element) 190*a* for delivering the signal to an addition point $A_P$ when the side ⓑ is selected, and a zero detector 190*b* for generating an output signal when an output of the addition point $A_{LP}$ has become zero, that is, $(\bar{h}-h)=0$ has been established. The transfer function $f_{KPI}$ of the component 190*a* is given by Eq. (4):

$$f_{KPI} = K_P(1 + \frac{1}{T_{ps}}) \quad (4)$$

$K_P$: compensation proportional constant of the looper position regulator portion, $T_P$: integration time constant of the looper position regulator portion.

Figure 6:
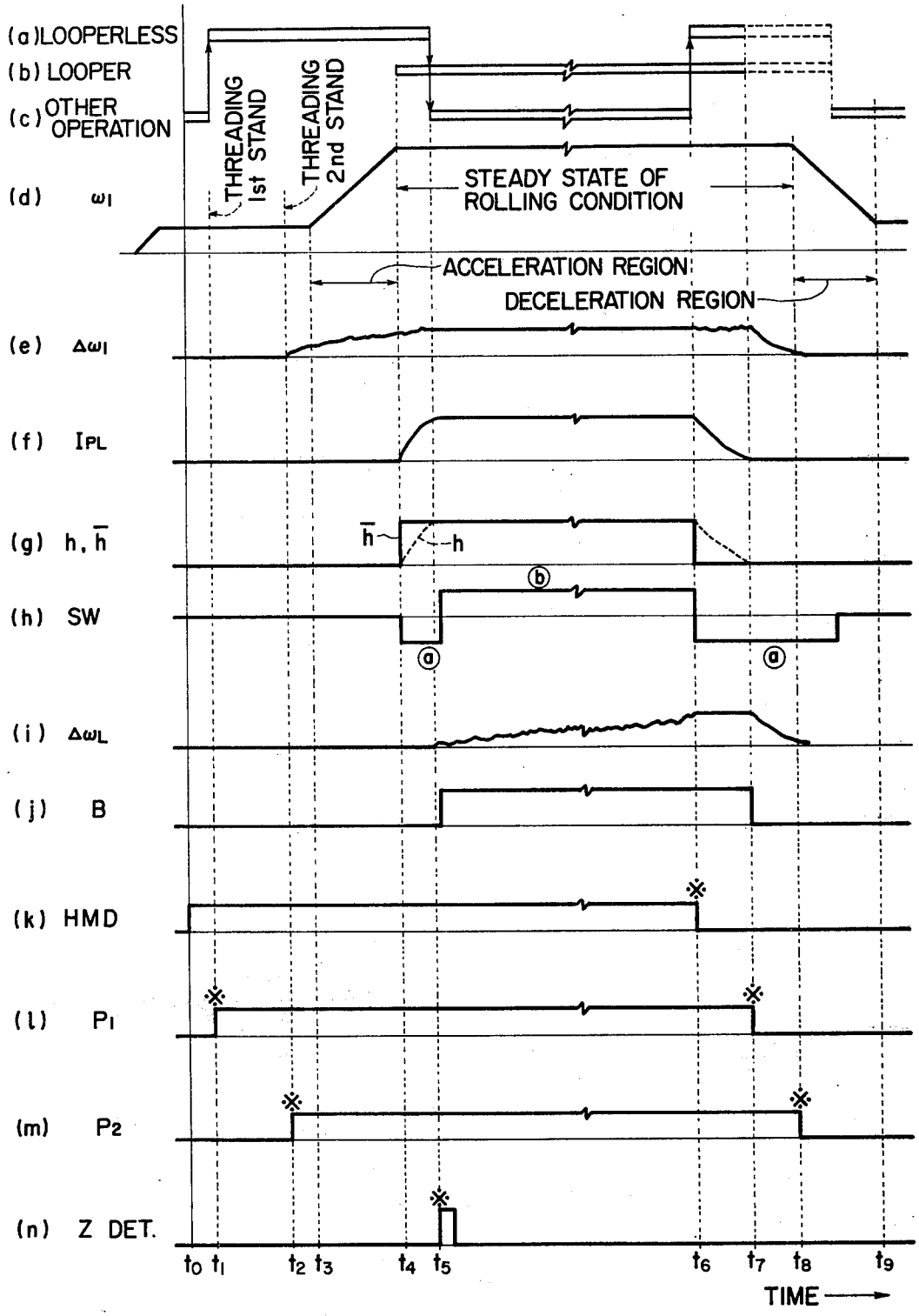
FIG. 6 shows a time chart for explaining the operation of the embodiment in FIGS. 3 and 4.

The zero detector 190*b* detects $(\bar{h}-h)=0$, which is utilized as an "interrupt" signal to the computer 200 ((n) at $t_5$ in FIG. 6).

Regarding the second stand, the corresponding parts indicate like devices and signals. $\tilde{\omega}_2$ denotes an output signal of the speed detector 152, $I_{L2}$ a current detection signal of the second-stand main motor 142, $P_2$ a load detection signal of the rolling pressure detector (load cell), $\omega_2$ a speed command signal of the second-stand main motor, and numeral 222 a thyristor equipment.

The operation of this embodiment will now be described with reference to FIGS. 5 and 6. In the example of the two stands 111 and 112 as illustrated in FIG. 3, before the workpiece reaches the first stand 111, the computer 200 sets the roll openings of the respective rolling stands (111 and 112 in this example), the rotational speeds of the main motors 141 and 142, etc. as determined on the basis of the rolling specifications 210.

When the workpiece is transferred in after the setting, the approach of the workpiece is detected by an HMD (hot metal detector) which is disposed on the incoming side of the first stand. As shown at (k) of a time chart in FIG. 6, the HMD detects the approach of the workpiece at time $t_0$ before the workpiece threads into the first stand.

When the workpiece has arrived at the first stand at time $t_1$, the load cell 121 detects the load $P_1$. The signal $P_1$ indicated at (l) in FIG. 6 turns "on." Upon the arrival of the workpiece 100 at the rolling stand 111, the computer 200 operates in conformity with a procedure shown in FIG. 5. Until the workpiece 100 reaches the rolling stand 112, the computer receives the current 171 and speed 151 of the main motor 141 of the first stand 111 and the rolling pressure 121 thereof, and it calculates a rolling load torque $G_1$ acting on the main motor and the ratio between $G_1$ and the rolling pressure $P_1$, $$(\frac{G_1}{P_1})_0.$$

This serves to determine a reference value for performing the non-contacting (looperless) tension control to be described later. Referring to the flow chart of the processing of data by the computer in FIG. 5, at a processing step 500, the data $P_1$, $\tilde{\omega}_1$ and $I_M$, the signal of the HMD, etc. are entered in cycles determined by a clock contained in the computer. At a processing step 502, whether or not the workpiece has been fed into the second stand is checked. When the workpiece does not reach the second stand, that is, when the top or foremost end of the workpiece lies between the first and second stands, the ratio $(G_1/P_1)_0$ of the first stand continues to be computed at a processing step 504.

When the workpiece has reached the second stand 112 meantime, the computer receives the main motor current 172 and rotational speed 152 and the rolling pressure 122 of the second stand and computes a load torque $G_2$ acting on the main motor 142 of the second stand 112 and a reference ratio of torque/rolling pressure $(G_2/P_2)$.

Letting I denote the current, V denote the voltage and $\omega$ denote the rotational speed, the rolling load torque G is obtained from the following relation:

$$G = \zeta_\phi \cdot I - J\frac{d\omega}{d\tau} - G_L$$
$$= \frac{VI}{\omega} - J\frac{d\omega}{d\tau} - G_L \quad (5)$$

where $\zeta_\phi$= coefficient of an induced voltage, J=moment of inertia, and $G_L$=loss torque.

The reference torque/rolling pressure ratio $$(\frac{G_2}{P_2})_0$$

of the second stand is calculated by the following equation:

$$(\frac{G_2}{P_2})_0 = (\frac{G_2}{P_2})_B - \frac{R_2}{R_1}(\frac{P_1}{P_2})_B\left\{(\frac{G_1}{P_1})_B - (\frac{G_1}{P_1})_0\right\} \quad (6)$$

where suffix B signifies values immediately after the workpiece has been fed into the rolling stand 112. $R_1$ and $R_2$ indicate roll radii.

Figure 5:
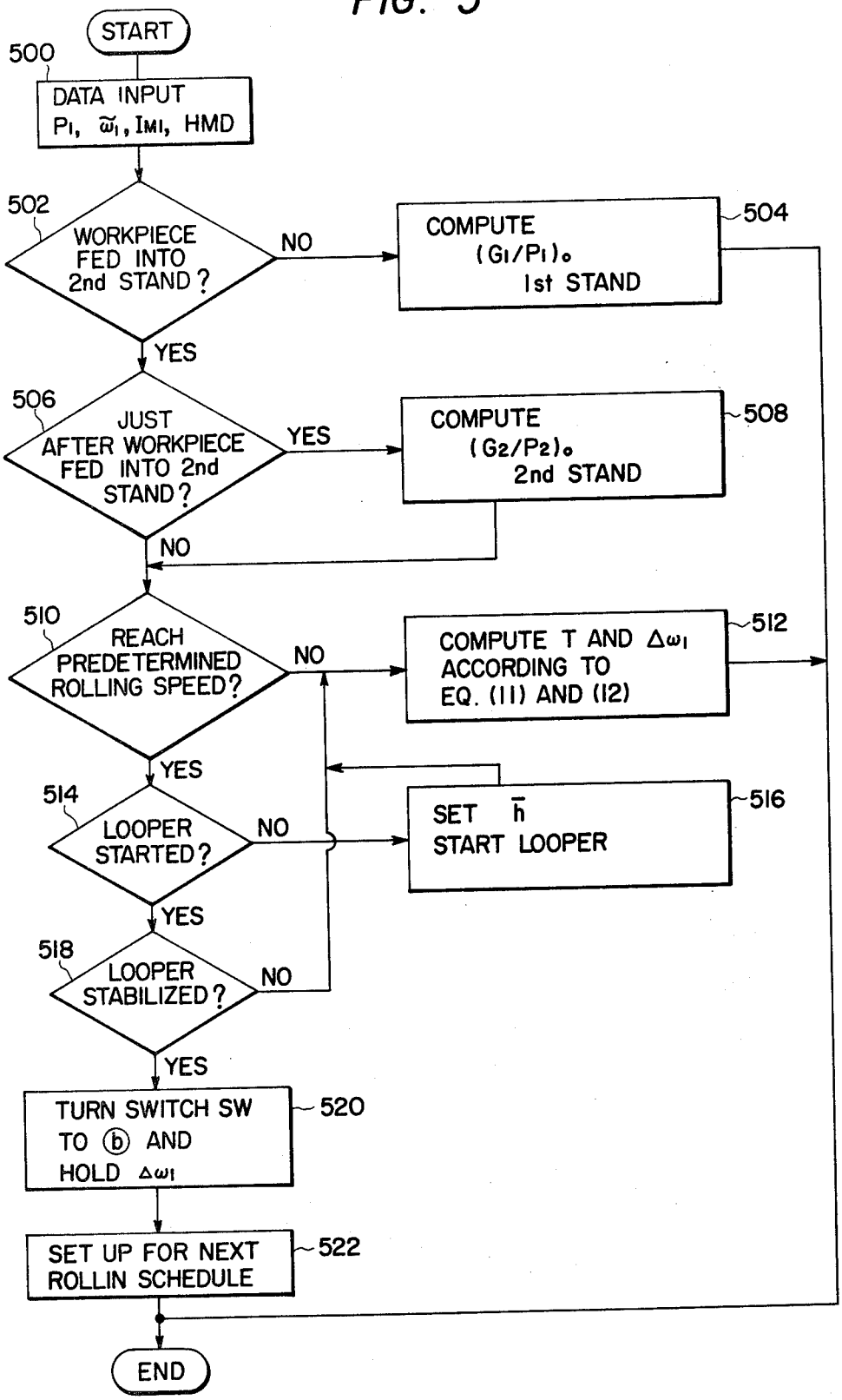
FIG. 5 shows a flow chart of processing steps in the case of executing the tension control with a computer.

At a step 506 in the processing flow chart of FIG. 5, whether or not the workpiece has been just threaded into the second stand is judged. If it has been just threaded, $(G_2/P_2)_0$ is computed according to Eq. (6) at a processing step 508.

The threading of the workpiece into the second stand will be understood from the fact that the signal $P_2$ at (m) in FIG. 6 turns "on" at time $t_2$.

When the workpiece has been threaded into the second stand, the rotational speed command value $\omega_1$ of the first stand and the deviation $\Delta\omega_1$ of the first stand are generated. These are shown at (d) and (e) in FIG. 6. As will be stated later, the deviation is computed according to Eq. (12).

Thereafter, the computer 200 controls the tension of the workpiece by the use of control equations to be stated below. It is well known that the following relations hold among the rolling torque G, the rolling pressure P and the tension T:

$$G_1 = 2 \cdot l_1 \cdot P_1 - R_1 \cdot T \quad (7)$$

$$G_2 = 2 \cdot l_2 \cdot P_2 + R_2 \cdot T \quad (8)$$

$l_1$ and $l_2$ are the torque arm coefficients of the first stand and the second stand, respectively. In case where the tension T is zero at the beginning of the rolling, they are values as given below:

$$2\,l_1 = \left(\frac{G_1}{P_1}\right)_0 \quad (9)$$

$$2\,l_2 = \left(\frac{G_2}{P_2}\right)_0 \quad (10)$$

Although the coefficients $l_1$ and $l_2$ change during the rolling, the quantities of the changes are mostly attributed to the temperature of the workpiece, and those of both the coefficients $l_1$ and $l_2$ can be considered substantially equal. Therefore, the variations of the coefficients $l_1$ and $l_2$ from the values of Eqs. (9) and (10) are let to be $\Delta l$, and $\Delta l$ is eliminated from Eqs. (7) and (8). Then, the tension computing equation given below can be derived:

$$T = \frac{\left\{\left(\frac{G_1}{P_1}\right)_0 - \left(\frac{G_1}{P_1}\right)\right\} - \left\{\left(\frac{G_2}{P_2}\right)_0 - \left(\frac{G_2}{P_2}\right)\right\}}{\left(\frac{R_1}{P_1} + \frac{R_2}{P_2}\right)} \quad (11)$$

After the arrival of the workpiece 100 at the second stand 112, until the rolling speed becomes a stipulated one, the computer receives the currents 171, 172, voltages, speeds 151, 152 and rolling pressures 121, 122 of the main motors 141, 142 of the respective rolling stands 111, 112, computes the rolling load torques $G_1$, $G_2$ according to Eq. (5) and computes the interstand tension according to Eq. (11). In order to correct the speed $\omega_1$ of the main motor 141 of the rolling stand 111 by the following value on the basis of the deviation between the tension T and a stipulated desired tension $T_d$, the computer computes the value:

$$\Delta\omega_1 = K\,(T - T_d) \quad (12)$$

K: control gain, and it delivers $\Delta\omega_1$ to the main motor controller 161. At time $t_3$, an acceleration region commences.

The computer 200 increases the rolling speed up to the stipulated one upon completion of the threading stage of the workpiece 100, and starts the looper control system at 180 and 190 upon arrival at the stipulated speed. More specifically, the switch sw in FIG. 4 is thrown onto the side ⓐ, i.e., side ①, a contact B is closed, and the position command $\bar{h}$ is given to the looper position regulator 190 from the computer 200. The position regulator 190 delivers an output to the looper current controller 180 in dependence on the difference between the looper position setpoint $\bar{h}$ and the output signal of the position detector 183 (corresponding to the component 5 in FIG. 1). The looper current controller 180 integrates the output signal of the position regulator 190 and prepares a current control pattern by means of the integrator 180*c* shown in FIG. 4. The current pattern and the detection signal of the current detector 185 are compared, and the gate control signal is prepared by the components 180*a* and 180*b* in accordance with the deviation of the comparison and is delivered to the thyristor equipment 223.

When the position of the looper has been stabilized to the predetermined position by the control as stated above, the computer 200 throws the switch sw in FIG. 4 onto the side ②, i.e., side ⓑ and simultaneously holds the signal of $\Delta\omega_1$ at a value at that time. Thus, the current controller 180 controls the current of the looper motor so as to come into coincidence with the current pattern held by the integrator 180*c*, and the position regulator 190 corrects the speed of the main motor in accordance with the positional deviation. In this manner, the control is smoothly changed-over to the tension control with only the looper control system.

These operations will be described in detail in correspondence with FIGS. 5 and 6. The acceleration region commences at the time $t_3$ in FIG. 6. The computer 200 checks at a processing step 510 if the predetermined speed has been reached. Unless the acceleration is completed, the tension T is computed according to Eq. (11) at a processing step 512, and also the speed correction quantity $\Delta\omega_1$ is computed according to Eq. (12) thereat.

When the predetermined speed has been reached, the computer 200 executes the setting of the looper control system, the setting of h in this case, and starts the looper at processing steps 514 and 516. The expression "starting of the looper" means to throw the switch sw in FIG. 4 onto the side ⓐ and to turn the contact B "on." Then, the computer computes the tension and the quantity $\Delta\omega_1$ by the processing step 512.

The operation of the switch sw and that of the contact B will be apparent from (h) and (j) in FIG. 6, respectively.

The setting of $\bar{h}$ is also done at time $t_4$. The actual looper position h is indicated by a dotted line at (g) in FIG. 6.

Subsequently, at a processing step 518 in FIG. 5, it is judged if the looper has been stabilized. As the criterion, it is checked if the looper position setpoint $\bar{h}$ and the actual looper position h have become equal, that is, if $\bar{h}-h=0$ has been established. If $\bar{h}-h\neq 0$, the control is made by executing the computation of the foregoing processing step 512. To execute the transaction via this processing step 512 is no other than the execution of the so-called looperless tension control.

When it is detected at the processing step 518 that $\bar{h}-h=0$ has been satisfied ((n) in FIG. 6), the computer 200 throws the switch sw in FIG. 4 onto the side b and holds $\Delta\omega_1$ at the value at that time.

Referring to FIG. 6, $\bar{h}-h=0$ is satisfied at time $t_5$, and the switch sw is changed-over from ⓐ to ⓑ as shown at (h). The contact B is turned "on" as shown at (j), $I_{PL}$ is held as shown at (f), and $\Delta\omega_1$ is held as shown at (e).

Here, the region of the looperless tension control and the region of the tension control with the looper will be seen at (a), (b) and (c) in FIG. 6. The computer is engaged in any other processing till the time $t_1$, and is switched to the looperless operation at the time $t_1$. Although the tension control with the looper starts at the time $t_4$, it coexists with the looperless control because it is not stabilized yet. The coexistent region lies in a period $t_4$–$t_5$. The tension control with the looper has become stable at the time $t_5$, so that the operation mode is changed-over to the tension control with the looper. It turns out that the computer executes any other operation.

When the signal of the HMD turns "off" at time $t_6$ in FIG. 6, it becomes known that the tail-out stage will occur soon, and hence, the switch sw is again thrown onto the side ⓐ. The desired looper position value $\bar{h}$ becomes zero, and the looper is therefore lowered down to the position at which it does not touch the workpiece during the looperless control.

When, at time $t_7$, the tail-out from the first stand is detected by turn-off of the signal $P_1$, the contact B is turned "off" and virtually the looperless tension control is changed-over to. When, at time $t_8$, the tail-out from the second stand is detected by turn-off of the signal $P_2$, a deceleration region commences. The decelerated tail-out terminates at time $t_9$. (d) in FIG. 6 represents the speed signal pattern given from the computer 200. $\Delta\omega_L$ at (i) indicates the output signal on the side ② of the looper position regulator 190, which signal has a value corresponding to $\Delta\omega_1$ during the looperless tension control. Marks in, for example, the signal $P_1$, (1) at the time $t_1$ signify that the mode change-over, the change-over of the switch sw, etc. are carried out by using the changes of the corresponding signals as trigger signals.

In case where the stableness of the looper is detected at the processing step 518 in FIG. 5, the change-over of the switch sw to the side ⓑ and the holding of the value $\Delta\omega_1$ are executed at the processing step 520, and a processing such as set-up for the next rolling is executed at a processing step 522.

After all, when the system is viewed from the side of the computer, the tension control is effected by the looper in a period $t_5$–$t_6$, and the computer itself can execute the other operation.

With this measure, any special circuit for the "soft touch" of the looper becomes unnecessary. Accordingly, the impact at the rise of the looper is avoided, and the damage of the workpiece is prevented. This method also has the merit that the correction of the gain as based on the angle of the looper may be little, so the precision of the tension control is raised.

After the switch sw has been thrown onto the side ⓑ, the computer 200 carries out the computation of set-up values such as roll opening and rolling speed for a workpiece to be subsequently rolled, the data logging, the preparation of a report, etc. When the rolling becomes close to termination, the computer 200 disconnects the looper system and starts the control according to Eq. (11). In judging the approach to the termination of the rolling, the hot metal detector or the like is disposed on the incoming side of the rolling stand 111, and its trigger signal is utilized.

Figure 7:
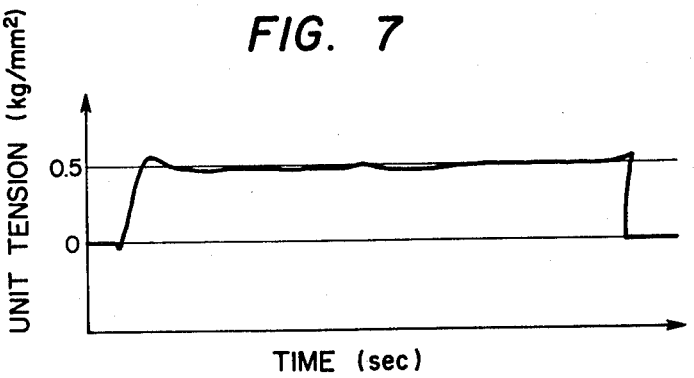
FIG. 7 shows an example of simulation in the case where this invention is applied.

For reference, FIG. 7 shows the result of a simulation performed under the same conditions as in FIG. 2. By comparing both the graphs, it is understood that the tension control characteristic has been remarkably improved.

In the above, this invention has been set forth in detail. To sum up, this invention is characterized by the system construction wherein the tension acting on the workpiece is controlled under the looperless state and by the non-contacting tension controller during the the threading stage of the top end, the acceleration or deceleration of the rolling, and the tail-out stage, and wherein it is controlled with the looper during the steady speed rolling during which the rolling is stable. Owing to such a construction, the looper controller need not cover the whole rolling process at high precision, but it may be a very simple controller because the control during the steady speed rolling only is intended. The computer system 200 may be made up of one conventional set-up computer, and any exclusive computer need not be used for the non-contacting tension control. That is, the single computer is used in time-sharing as illustrated in FIG. 6, whereby the effective utilization of the computer becomes possible. Although the present embodiment has been explained by taking the example in which the non-contacting tension control is made with the computer, it is needless to say that the control can also be realized by the analog control.

As regards the looper driving device, there has been exemplified the case of the motor-operated looper where the current or output torque of the motor is controlled to be constant. The looper, however, may well be a hydraulic looper or a pneumatic looper. In such a case, it is required to control the hydraulic pressure or pneumatic pressure into a constant value. That is, essentially required is to control the pushing-up force of the looper to be constant.

As explained in connection with the embodiment of this invention, the control modes are always shifted therebetween via the region in which the looperless tension control and the tension control employing the looper coexist. Therefore, neither the damage of the workpiece nor an excessive tension arises, and a stable tension control can be executed throughout the rolling process from the threading stage of the foremost end to the tail-out stage.

We claim:

1. In the control of a tension of a workpiece which is rolled by a tandem rolling mill, a tension control method for a rolling mill characterized in that a looperless tension control in which a tension is computed from a driving current for rolls and a rolling load and in which the tension is controlled in accordance with a deviation from a desired tension is executed during a threading stage of a top end of the workpiece and during a tail-out stage, while a tension control with a looper is executed during a steady rolling from completion of said threading stage of said top end to commencement of said tail-out stage, both the tension controls being changed-over in dependence on the rolling process so as to control said tension of said workpiece.

2. A tension control method for a rolling mill according to claim 1, characterized in that when the looperless tension control method is to be changed-over to the tension control method with the looper, the former is changed-over to the latter via a region in which both said control methods are simultaneously executed.

3. A tension control method for a rolling mill according to claim 1, characterized in that when the tension control method with the looper is to be changed-over to the looperless tension control method, the former is changed-over to the latter via a region in which both said control methods are simultaneously executed.

4. A tension control method for a rolling mill according to claim 1, characterized in that when said threading stage of said top end is to shift to said steady rolling and when the steady rolling stage is to shift to said tail-out stage, a region in which said tension control with the looper and said looperless tension control are simultaneously executed is involved.

5. A tension control method for a rolling mill according to claim 2, characterized in that during the execution of said looperless tension control method, a predetermined looper-position command value is set, a position controller for said looper being driven, and that when a position of said looper has reached the command value, said tension control method with said looper is changed-over to.

6. A tension control method for a rolling mill according to claim 5, characterized in that a speed correction quantity of a main motor at the time when the position of said looper has reached said command value and when said tension control with said looper is to be changed-over to is held, whereby said tension control method with said looper is changed-over to.

7. A tension control method for a rolling mill according to claim 1, characterized in that when said looperless tension control is to be changed-over to said control method with the looper, an operation of a positional control of said looper is started by a signal of completion of an acceleration region.

8. A tension control method for a rolling mill according to claim 3, characterized in that a speed correction quantity of a looper motor at the time when the tension control method with the looper is to be changed-over to the looperless tension control method is held, whereby said looperless tension control method is changed-over to.

9. A tension control method for a rolling mill according to claim 1, characterized in that the looper is a motor-operated looper, a load current value of a looper driving motor being controlled into a predetermined value, thereby controlling a pushing-up force of said looper to be constant.

10. In the tension control method wherein the tension control with the looper according to claim 1 is executed, a tension control method for a rolling mill characterized in that a control which renders a pushing-up force of said looper constant and a control which renders a position of said looper constant are executed.

11. In the tension control method wherein the tension control for the rolling mill according to claim 1 is executed, a tension control method for a rolling mill characterized in that a control portion of a main motor for driving each rolling stand is constructed of a speed control loop and a current control loop for said motor, and that a current command-correcting value proportional to a rolling pressure is added as an input of said current control loop, thereby to execute a current control of said main motor.

12. A tension control method for a rolling mill according to claim 3, characterized in that said looperless tension control method is changed-over to by a detection signal of the tail-out through a stand situated upstream of said looper.

* * * * *